US011828213B2

(12) United States Patent
Zhao et al.

(10) Patent No.: US 11,828,213 B2
(45) Date of Patent: Nov. 28, 2023

(54) SEPARATION ASSEMBLY WITH MULTIPLE SEPARATORS AND A SINGLE JET PUMP ASSEMBLY

(71) Applicant: Cummins Filtration Inc., Nashville, TN (US)

(72) Inventors: Yubao Zhao, Wuhan (CN); Peter K. Herman, Stoughton, WI (US); Benjamin L. Scheckel, Stoughton, WI (US); Arun Janakiraman, Stoughton, WI (US); Vijay Dinkar Kolhe, Nashik (IN); Navin Surana, Rajnandgaon (IN)

(73) Assignee: CUMMINS FILTRATION INC., Nashville, TN (US)

( * ) Notice: Subject to any disclaimer, the term of this patent is extended or adjusted under 35 U.S.C. 154(b) by 0 days.

(21) Appl. No.: 17/802,300

(22) PCT Filed: Feb. 25, 2021

(86) PCT No.: PCT/US2021/019669
§ 371 (c)(1),
(2) Date: Aug. 25, 2022

(87) PCT Pub. No.: WO2021/173834
PCT Pub. Date: Sep. 2, 2021

(65) Prior Publication Data

US 2023/0091372 A1 Mar. 23, 2023

(30) Foreign Application Priority Data

Feb. 27, 2020 (CN) ..... 202010123737.8

(51) Int. Cl.
*F01M 13/04* (2006.01)
*F02M 25/06* (2016.01)

(52) U.S. Cl.
CPC ..... *F01M 13/04* (2013.01); *F02M 25/06* (2013.01)

(58) Field of Classification Search
CPC .. F01M 13/0011; F01M 13/028; F01M 13/04; F01M 2013/0433; F01M 2013/026;
(Continued)

(56) References Cited

U.S. PATENT DOCUMENTS 6,684,864 B1 * 2/2004 Busen ..... F01M 13/04 123/41.86
7,406,961 B2 * 8/2008 Hilpert ..... B04C 11/00 123/572
(Continued)

FOREIGN PATENT DOCUMENTS

CN 101730787 B 6/2010
CN 103764252 A 4/2014
(Continued)

OTHER PUBLICATIONS

First Examination Report for Indian Patent App. No. 202247048401 dated Oct. 12, 2022, 5 pages.
(Continued)

*Primary Examiner* — George C Jin
*Assistant Examiner* — Teuta B Holbrook
(74) *Attorney, Agent, or Firm* — Foley & Lardner LLP

(57) ABSTRACT

The application relates to a separation assembly with multiple separators and a single jet pump assembly. A separation assembly comprises a first crankcase ventilation separator comprises a first drain outlet, a second crankcase ventilation separator that comprises a second drain outlet, and a jet pump assembly. The jet pump assembly comprises a first drain inlet fluidly connected to the first drain outlet of the first crankcase ventilation separator and a second drain inlet fluidly connected to the second drain outlet of the second
(Continued)

crankcase ventilation separator. The jet pump assembly provides suction pressure to both the first drain outlet of the first crankcase ventilation separator and the second drain outlet of the second crankcase ventilation separator.

22 Claims, 13 Drawing Sheets

(58) Field of Classification Search
CPC ..... F02B 37/005; B03C 3/017; F24D 11/007; F24D 11/008; B01D 45/04; B01D 46/0086; B01D 45/08; B01D 45/16; B01D 46/0005; B01D 46/0019; B01D 50/002; B01D 45/12
See application file for complete search history.

(56) References Cited

U.S. PATENT DOCUMENTS

| | | | | |
|---|---|---|---|---|
| 9,347,346 | B2 * | 5/2016 | Schleiden | B01D 50/20 |
| 2006/0196482 | A1 | 9/2006 | Kakimoto et al. | |
| 2009/0025662 | A1 | 1/2009 | Herman et al. | |
| 2012/0318215 | A1 | 12/2012 | Copley et al. | |
| 2013/0206675 | A1 * | 8/2013 | Koslowski | B01D 29/114 210/450 |
| 2013/0276743 | A1 | 10/2013 | Statter et al. | |
| 2014/0096753 | A1 * | 4/2014 | Monros | F01M 13/04 123/574 |
| 2014/0165977 | A1 | 6/2014 | Copley et al. | |
| 2014/0352539 | A1 * | 12/2014 | Schleiden | B01D 46/56 95/272 |
| 2015/0020785 | A1 | 1/2015 | An et al. | |
| 2016/0032798 | A1 * | 2/2016 | Herman | B01D 45/12 96/372 |

FOREIGN PATENT DOCUMENTS

| | | | | |
|---|---|---|---|---|
| CN | 104411944 | A | 3/2015 | |
| CN | 105484826 | A | 4/2016 | |
| DE | 10024769 | A1 * | 11/2001 | F01M 13/021 |
| DE | 102008061058 | B4 * | 2/2017 | B01D 45/14 |
| DE | 10 2013 006 954 | B4 | 12/2019 | |
| DE | 102018211760 | A1 * | 1/2020 | F01M 13/04 |
| WO | WO-2019/211396 | A1 | 11/2019 | |

OTHER PUBLICATIONS

First Office Action for Chinese Patent App. No. 202010123737 dated Oct. 8, 2022, 10 pages (with English translation).
International Search Report and Written Opinion issued for PCT Application No. PCT/US2021/019669 dated May 7, 2021, 12 pages.

* cited by examiner

SEPARATION ASSEMBLY WITH MULTIPLE SEPARATORS AND A SINGLE JET PUMP ASSEMBLY

CROSS-REFERENCE TO RELATED PATENT APPLICATIONS

This application is a National Phase of PCT Application No. PCT/US2021/019669, filed Feb. 25, 2021, which claims priority to and the benefit of Chinese Patent Application No. 202010123737.8, and filed Feb. 27, 2020. The contents of these applications are incorporated by reference in their entireties.

TECHNICAL FIELD

The present application relates generally to separation assemblies with a jet pump assembly providing a suction pressure to multiple crankcase separators.

BACKGROUND OF THE RELATED ART

In conventional separation assemblies with one crankcase ventilation (CV) separator, one oil-drive jet pump with one check valve drives the single CV separator. However, the separation assembly may include more than one CV separator.

SUMMARY

Various embodiments provide for a separation assembly that comprises a first crankcase ventilation separator comprises a first drain outlet, a second crankcase ventilation separator that comprises a second drain outlet, and a jet pump assembly. The jet pump assembly comprises a first drain inlet fluidly connected to the first drain outlet of the first crankcase ventilation separator and a second drain inlet fluidly connected to the second drain outlet of the second crankcase ventilation separator. The jet pump assembly provides suction pressure to both the first drain outlet of the first crankcase ventilation separator and the second drain outlet of the second crankcase ventilation separator.

Various other embodiments provide for a separation assembly that comprises a first crankcase ventilation separator comprising a first drain outlet, a second crankcase ventilation separator comprising a second drain outlet, and a jet pump assembly fluidly connected to the first drain outlet of the first crankcase ventilation separator and the second drain outlet of the second crankcase ventilation separator. The jet pump assembly provides suction pressure to both the first drain outlet of the first crankcase ventilation separator and the second drain outlet of the second crankcase ventilation separator.

Various other embodiments provide for a jet pump assembly. A first drain inlet is fluidly connected to a first drain outlet of a first crankcase ventilation separator. A second drain inlet is fluidly connected to a second drain outlet of a second crankcase ventilation separator. A motive inlet draws fluid from the first drain inlet and the second drain inlet through the jet pump assembly. The jet pump assembly provides suction pressure to both the first drain outlet of the first crankcase ventilation separator and the second drain outlet of the second crankcase ventilation separator.

These and other features (including, but not limited to, retaining features and/or viewing features), together with the organization and manner of operation thereof, will become apparent from the following detailed description when taken in conjunction with the accompanying drawings, wherein like elements have like numerals throughout the several drawings described below.

DETAILED DESCRIPTION

Referring to the figures generally, various embodiments disclosed herein relate to a separation assembly with at least two crankcase ventilation (CV) separators and a single jet pump assembly that provides suction to the at least two CV separators. To regulate the fluid flow between each of the CV separators and the jet pump assembly, the separation assembly comprises orifice assemblies along the respective fluid flow paths between each of the CV separators and the jet pump assembly.

If multiple CV separators are needed within a separation assembly, a single jet pump assembly may be attached and provide suction to the multiple CV separators. Each of the drain lines positioned between a respective CV separator and the jet pump assembly may have a "J" shape (due to the relative positioning between the CV separators and the jet pump assembly). However, the "J" shape of the drain line may create a potential oil trap along the length of the drain lines.

Ideally, the suction or pressure exerted on each of the drain lines from the jet pump assembly creates the same volumetric flow from each fluid flow path. However, the suction exerted on each drain line may not be equal since the oil flow within each drain line may differ slightly and/or one of the fluid flow paths may develop a hydraulic lock or be hydrolocked (e.g., oil-locked) in the "J" bend. Since a single jet pump assembly is used to provide suction to each of the drain lines, trapped oil within one of the drain lines results in a pressure differential between each of the drain lines (via the jet pump assembly), which causes all of the suction to be diverted to a single one of the drain lines (thereby completely emptying the single one drain line of liquid and subsequently only pulling air through the one emptied drain line). Since all of the suction is diverted to one of the drain lines, the other drain lines remain hydrolocked and do not provide any volumetric flow. Accordingly, as described further herein, the separation assembly includes orifice assemblies to prevent the drain lines from hydrolocking.

Separation Assembly

Figure 1:
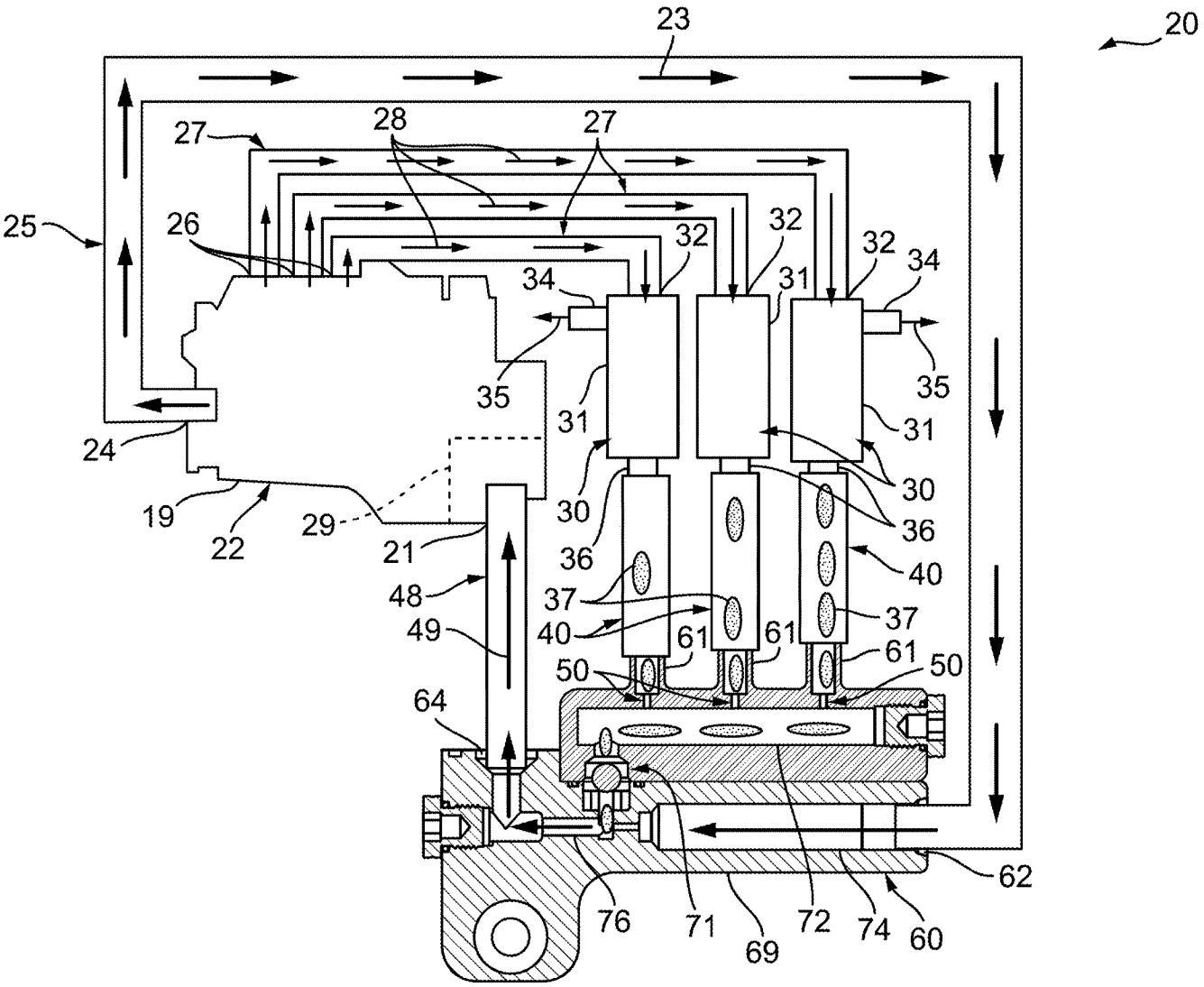
FIG. 1 is a schematic view of a separation assembly according to one embodiment.
Figure 5:
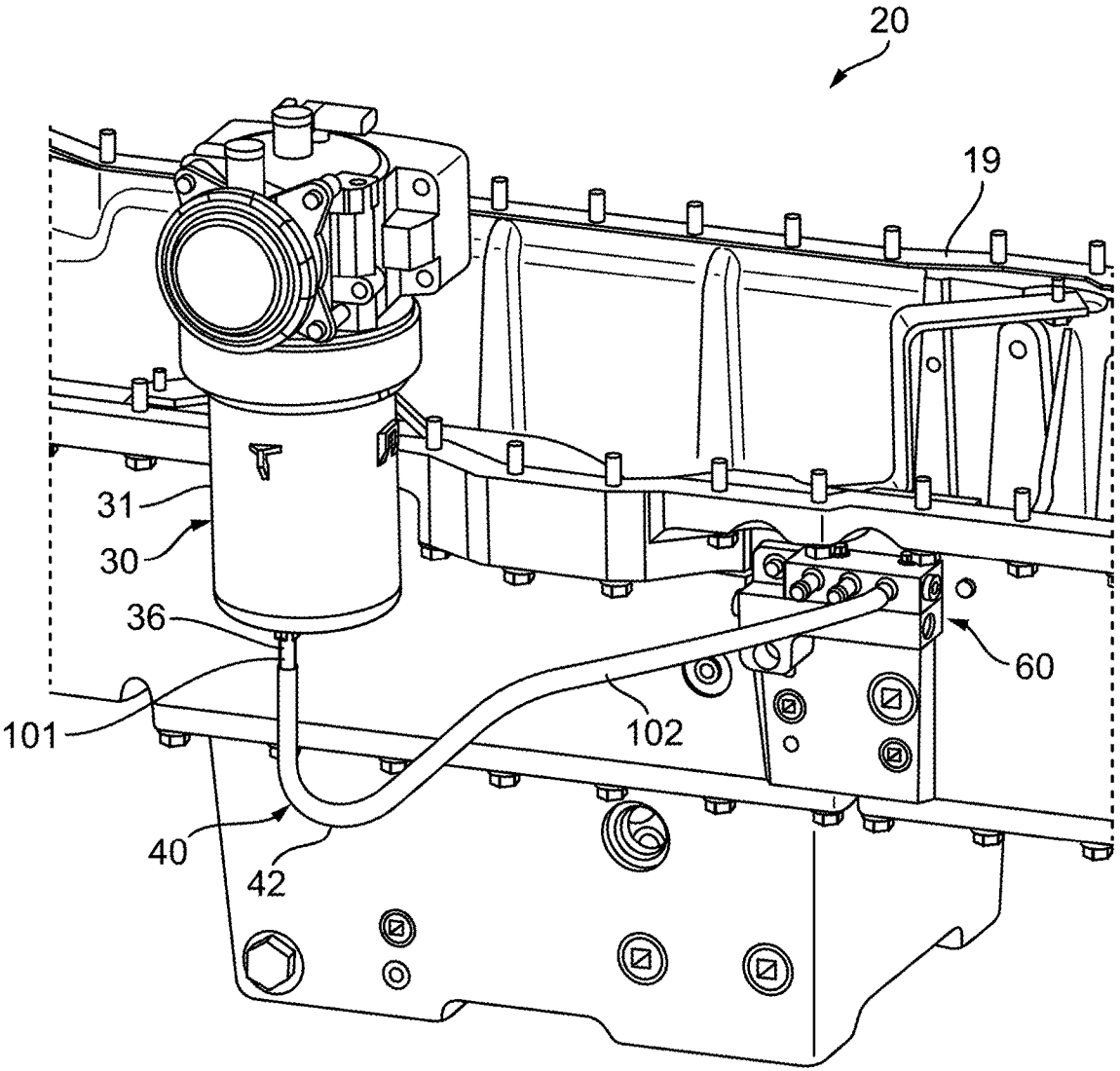
FIG. 5 is a perspective view of a portion of a separation assembly according to various embodiments.

As shown in FIG. 1, a separation system or assembly 20 is fluidly coupled to an engine 22 and includes a plurality of CV separators 30 (or a single CV separator 30 as shown in FIG. 5), a jet pump assembly 60 (optionally a single jet pump assembly 60), and a plurality of drain lines 40. Each drain line 40 is fluidly coupled to one of the plurality of CV separators 30 and connects each of the CV separators 30 to the single jet pump assembly 60. To regulate the fluid flow between each of the CV separators 30 and the jet pump assembly 60, the separation assembly 20 further comprises a plurality of throttling orifice assemblies 50, each corresponding to one of the plurality of CV separators 30 and the plurality of drain lines 40.

To fluidly connect the various components of the separation assembly 20, the separation assembly 20 further comprises various other fluid lines, such as a drive line 25 (which fluidly connects the drive outlet 24 of the engine 22 to the motive inlet 62 of the jet pump assembly 60), unfiltered fluid lines 27 (each of which fluidly connect one of the unfiltered fluid outlets 26 of the engine 22 to an inlet 32 of one of the CV separators 30), the drain lines 40 (each of which fluidly connect a discharge or drain outlet 36 of one of the CV separators 30 to one of the drain inlets 61 (which may also be referred to as an inlet) of the jet pump assembly 60), and a discharge line 48 (which fluidly connects an outlet 64 of the jet pump assembly 60 to an inlet 21 of the engine 22).

The separation assembly 20 may include two or more CV separators 30. In the embodiment depicted in FIG. 1, the separation assembly 20 includes three CV separators 30. Depending on the number of CV separators 30 within the separation assembly 20, the separation assembly 20 comprises a corresponding (and optionally equal) number of flow paths, unfiltered fluid outlets 26 of the engine 22, unfiltered fluid lines 27, drain lines 40, orifice assemblies 50, drain inlets 61 of the jet pump assembly 60, and fittings 78 (as shown in FIG. 4A) of the jet pump assembly 60.

For simplicity of explanation, the CV separator 30 (and its various components) disclosed herein refers to any of the CV separators within the separation assembly 20 (e.g., a first CV separator, a second CV separator, etc.). Similarly, the flow path disclosed herein refers to any of the flow paths between a CV separator 30 and the jet pump assembly 60 (e.g., a first flow path, a second flow path, etc.), the drain line 40 (and its various components) disclosed herein refers to any of the drain lines (e.g., a first drain line, a second drain line, etc.), the orifice assembly 50 (and its various components) disclosed herein refers to any of the orifice assemblies (e.g., a first orifice assembly, a second orifice assembly, etc.), the drain inlet 61 of the jet pump assembly 60 (and its various components) disclosed herein refers to any of the drain inlets of the jet pump assembly 60 (e.g., a first drain inlet, a second drain inlet, etc.), the fittings 78 of the jet pump assembly 60 (and its various components) (as shown in FIG. 4A) disclosed herein refers to any of the fittings 78 of the jet pump assembly 60 (e.g., a first fitting, a second fitting, etc.), the unfiltered fluid outlet 26 of the engine 22 (and its various components) disclosed herein refers to any of the unfiltered fluid outlets (e.g., a first unfiltered fluid outlet, a second unfiltered fluid outlet, etc.), and the unfiltered fluid line 27 (and its various components) disclosed herein refers to any of the unfiltered fluid lines (e.g., a first unfiltered fluid line, a second unfiltered fluid line, etc.).

Engine

As shown in FIG. 1, the engine 22 comprises an inlet 21, a drive outlet 24, and at least two unfiltered fluid outlets 26. The inlet 21 is configured to receive discharge fluid 49 from the outlet 64 of the jet pump assembly 60. The engine 22 is configured to pump a pressurized drive fluid 23 (such as a high-pressurized air or oil) out from the drive outlet 24, into and through the drive line 25, and into the motive inlet 62 of the jet pump assembly 60 (as described further herein) to power the jet pump assembly 60. The engine 22 is also configured to output (e.g., pump) unfiltered fluid 28 (e.g., dirty or unfiltered air) out from each of the unfiltered fluid outlets 26, into and through respective unfiltered fluid lines 27 and into the respective inlets 32 of each of the CV separators 30. According to one embodiment, the number of unfiltered fluid outlets 26 that the engine 22 comprises may directly correspond to (and equal) the number of CV separators 30 that the separation assembly 20 comprises. However, according to other embodiments, there may be only one unfiltered fluid outlet 26 of the engine 22 that fluidly splits downstream to flow into different inlets 32 of different CV separators 30.

Figure 2A:
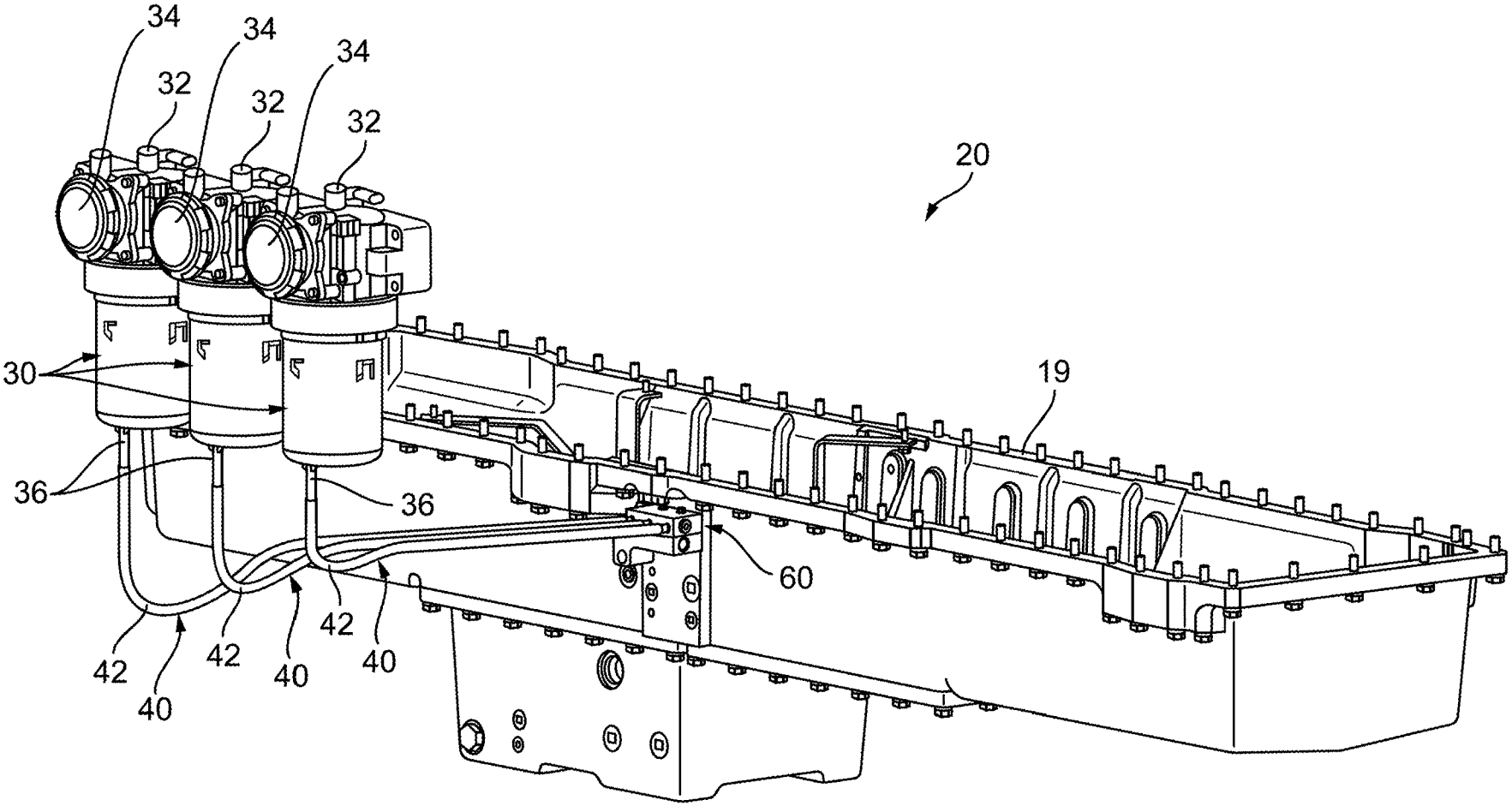
FIG. 2A is a perspective view of a portion of the separation assembly of FIG. 1.
Figure 2B:
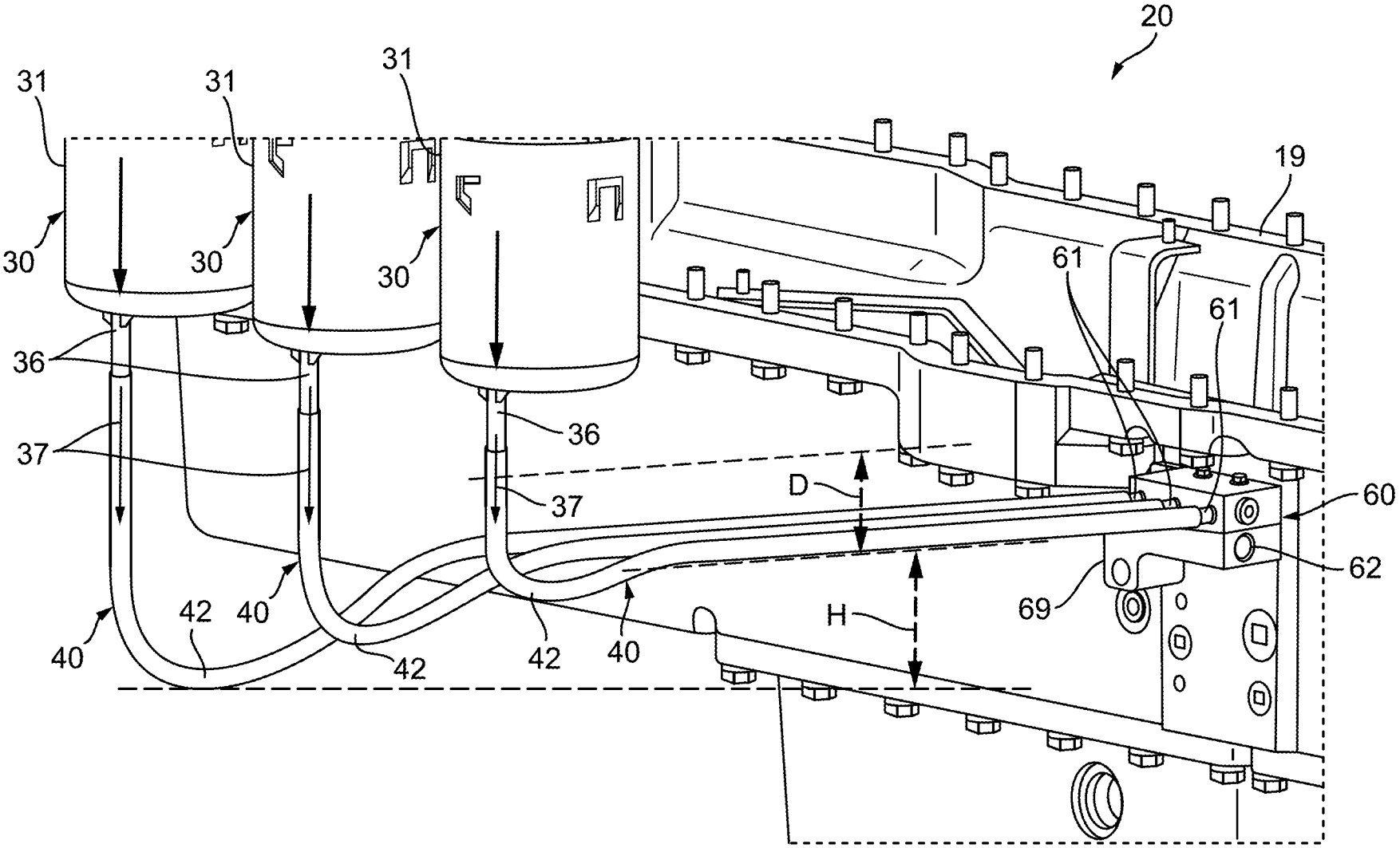
FIG. 2B is a perspective view of a portion of the separation assembly of FIG. 1.

As shown in FIG. 1, the engine 22 may be positioned within an engine housing 19. As shown in FIGS. 2A-2B, the CV separators 30 and the jet pump assembly 60 may optionally be attached to an outer surface of the engine housing 19.

As shown in FIG. 1, the engine 22 may also include a sump 29 (e.g., an oil sump) that is configured to receive the discharge fluid 49 from the discharge line 48 (and therefore from the outlet 64 of the jet pump assembly 60). Accordingly, the inlet 21 of the engine 22 may be located along (and direct fluid into) the sump 29.

CV Separators

The CV separators 30 are each configured to filter the unfiltered fluid 28 (e.g., dirty or unfiltered air) from the engine 22 through crankcase ventilation, thereby separating the unfiltered fluid 28 into a filtered fluid 35 (e.g., clean or filtered air) and a removed or drain fluid 37 (e.g., separated liquid, such as oil or oil drops). As shown in FIG. 1, each of the CV separators 30 includes a housing 31, an inlet 32, a filtered fluid outlet 34, and a drain outlet 36. Each of the inlet 32, the filtered fluid outlet 34, and the drain outlet 36 may extend from the body of the housing 31 and allow fluid to flow through the housing 31.

As shown in FIG. 1, the inlet 32 of the CV separator 30 is configured to receive the unfiltered fluid 28 from the engine 22 (via the unfiltered fluid line 27). The filtered fluid outlet 34 of the CV separator 30 is configured to release filtered fluid 35 (e.g., filtered air) out from the CV separator 30. The drain port or outlet 36 of the CV separator 30 is configured to drain or discharge the drain fluid 37 that has been removed from the unfiltered fluid 28 within the CV separator 30 into a respective one of the drain lines 40 (to flow into the jet pump assembly 60 through a respective one of the drain inlets 61).

The separation assembly 20 provides a drain loop or fluid flow path between each of the CV separators 30, the corresponding drain line 40, and the corresponding drain inlet 61 of the jet pump assembly 60 (and the rest of the separation assembly 20) such that multiple fluid flow paths (from each of the CV separators 30) flow to the same jet pump assembly 60. For example, the flow path originates in the CV separator 30, flows or extends through the drain outlet 36 of the CV separator 30, flows or extends through the corresponding drain line 40, and flows or extends into the jet pump assembly 60 through the corresponding drain inlet 61 (and optionally via the corresponding fitting 78, as shown in FIGS. 4A-4C).

Drain Lines

Figure 4B:
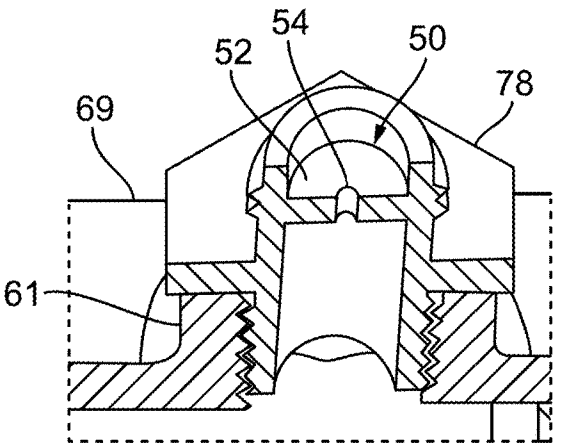
FIG. 4B is an enlarged view of a portion of the jet pump assembly of FIG. 4A.
Figure 4A:
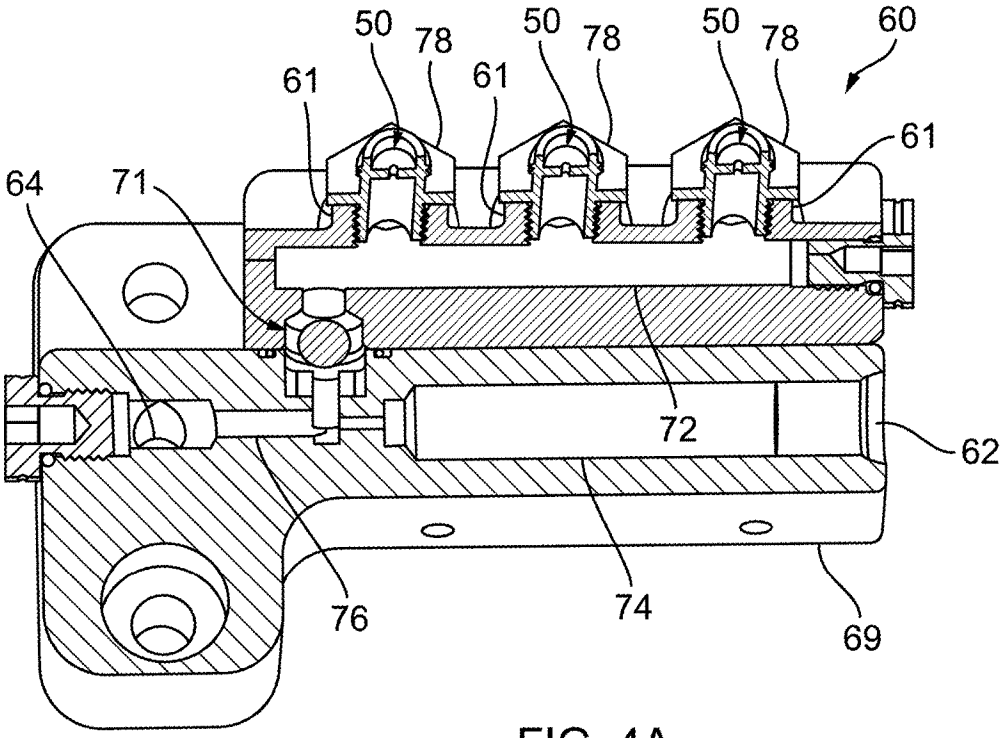
FIG. 4A is a cross-sectional view of a jet pump assembly according to another embodiment.
Figure 4C:
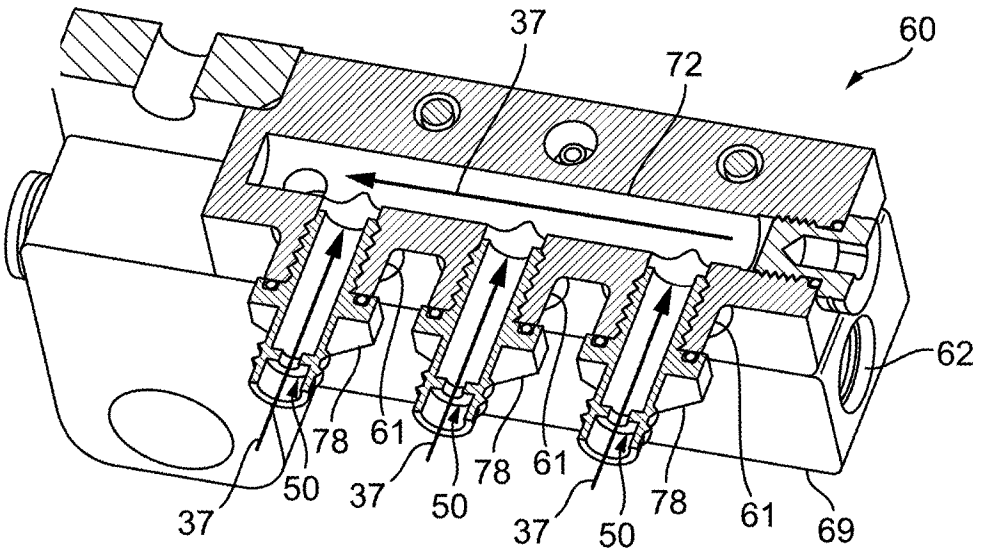
FIG. 4C is another cross-sectional view of the jet pump assembly of FIG. 4A.

As shown in FIGS. 1-2B, each of the drain lines 40 are configured to fluidly connect the drain outlet 36 of one of the CV separators 30 to one of the drain inlets 61 of the jet pump assembly 60 and defines a portion of the flow path between the CV separator 30 and the jet pump assembly 60, thereby allowing the drain fluid 37 from the CV separator 30 to flow out from the CV separator 30 (through the drain outlet 36), through the drain line 40, and into the jet pump assembly 60 (through the drain inlet 61, and optionally through the fitting 78 (as shown in FIGS. 4A-4C)). Since all of the drain lines 40 (and therefore all of the drain inlets 61) are fluidly connected to a common plenum 72 of the jet pump assembly 60 prior to flowing through the check valve 71 and mixing with the drive fluid 23 within the suction chamber 76, all of the drain lines 40 have the same suction source (from the drive chamber 74 and the suction chamber 76) within the jet pump assembly 60.

An upstream inlet of each of the drain lines 40 is fluidly attached or connected to (and may extend into or over) the drain outlet 36 of one of the CV separators 30 such that the drain fluid 37 from the CV separator 30 flows into the inlet of the drain line 40. A downstream outlet of each of the drain lines 40 is fluidly attached or connected to (and may extend into or over) one of the drain inlets 61 of the jet pump assembly 60 (optionally via one of the fittings 78) such that the drain fluid 37 from the outlet of the drain line 40 flows into the drain inlet 61 of the jet pump assembly 60.

The various drain lines 40 may carry a variety of different types of drain fluid 37 (and may carry the same or different drain fluid 37 as each other). For example, the drain fluid 37 may be a liquid (such as oil drops or storage oil) or clean fluid (e.g., primarily air).

As shown in FIGS. 2A-2B, each of the drain lines 40 may include a J-bend or bent portion 42 along which the drain line 40 curves or bends along its length between the CV separator 30 and the jet pump assembly 60. The bent portion 42 results from the CV separators 30 being relatively vertically and horizontally close to the respectively drain inlets 61 of the jet pump assembly 60. The bent portion 42 is the portion of the drain line 40 that is curved and vertically below the drain inlets 61 (where the CV separators 30 and their drain outlets 36 are vertically above the drain inlets 61). Accordingly, the drain lines 40 have a "J" shape along their length due to the bent portion 42. In conventional separation assemblies, this "J" shape would have otherwise created a potential J fluid trap (e.g., a J oil-trap) along the bent portion 42. However, due to the orifice assembly 50 (as described further herein), this fluid trap is prevented.

Jet Pump Assembly

As shown in FIGS. 1 and 2B, the jet pump manifold or assembly 60 (which may also be referred to as a jet pump drain device) is configured to draw the drain fluid 37 out from each of the drain lines 40 corresponding to the at least two CV separators 30 and is driven by the drive fluid 23. For the example, the jet pump assembly 60 may be oil-driven or air-driven. Accordingly, the single jet pump assembly 60 is configured to provide suction pressure to and draw fluid from the respective drain outlets 36 of multiple CV separators 30 (via the corresponding drain lines 40) for a continuous drainage of drain fluid 37 from the at least two CV separators 30.

The jet pump assembly 60 may be powered by the engine 22 (as shown in FIG. 1). For example, the engine 22 may pump the pressurized drive fluid 23 into the jet pump assembly 60, which draws the drain fluid 37 into and through the jet pump assembly 60 (as described further herein).

Figure 3A:
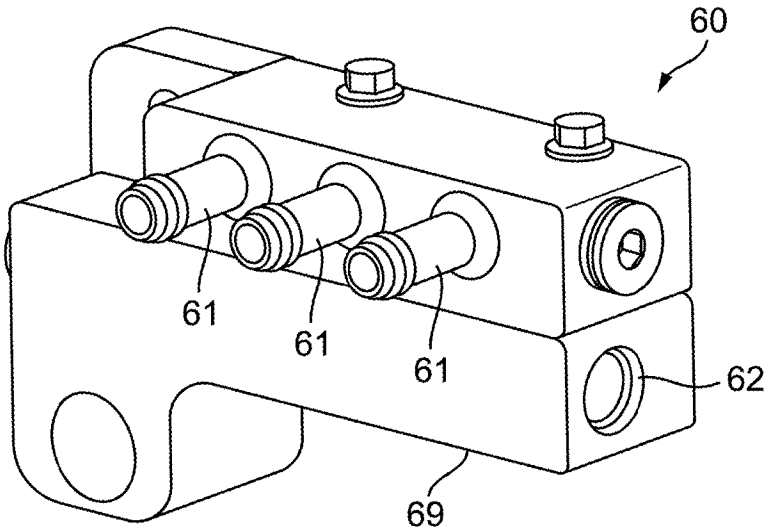
FIG. 3A is a perspective view of a jet pump assembly of the separation assembly of FIG. 1.
Figure 3B:
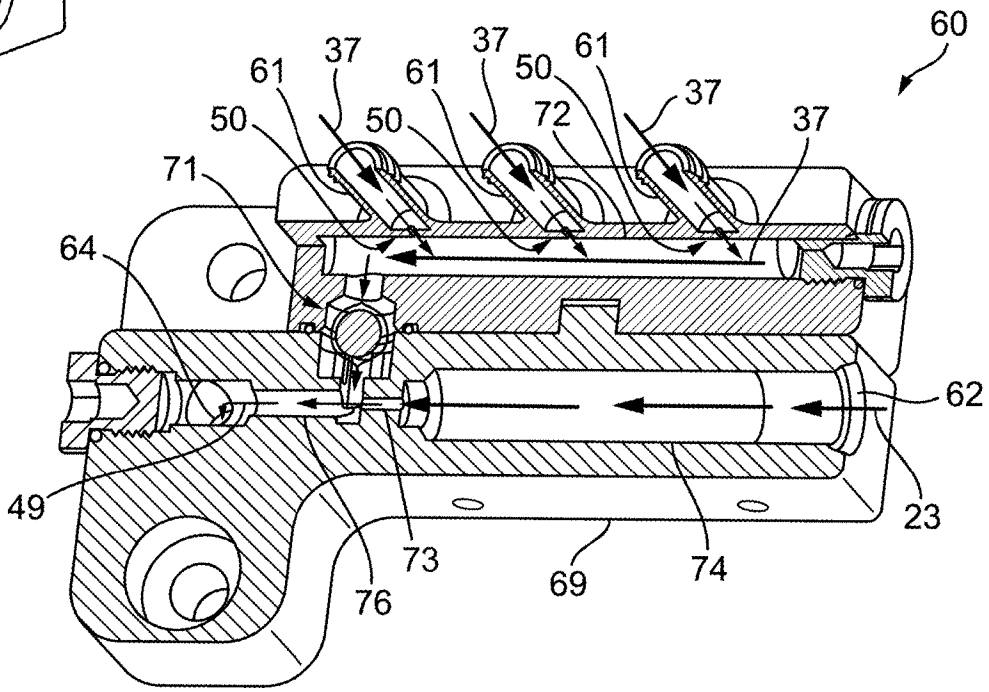
FIG. 3B is a cross-sectional view of the jet pump assembly of FIG. 3A.

As shown in FIGS. 3A-3B, the jet pump assembly 60 includes a jet pump casing or housing 69 through which the various fluids (e.g., the drive fluid 23, the drain fluid 37, and the discharge fluid 49) flow and within which the suction pressure is created to pull the drain fluid 37 from the CV separators 30, through the drain lines 40, and into the sump 29. The jet pump housing 69 may optionally be two pieces that are attached to each other, as shown in FIG. 3B. One of the pieces may include the common plenum 72, and the other piece may include the drive chamber 74 and the suction chamber 76. The two pieces may fluidly attach to each other along and via the check valve 71.

Figure 3D:
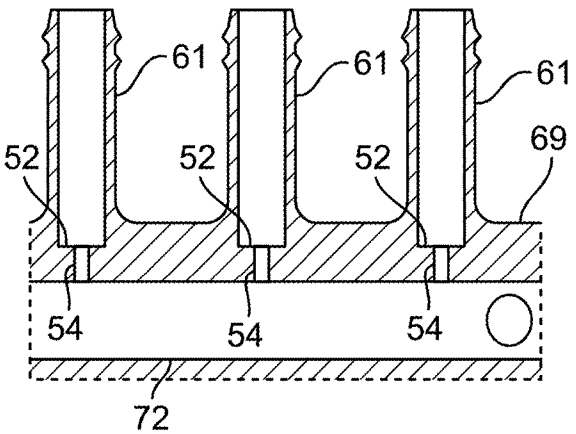
FIG. 3D is a cross-sectional view of a portion of the jet pump assembly of FIG. 3A.
Figure 3E:
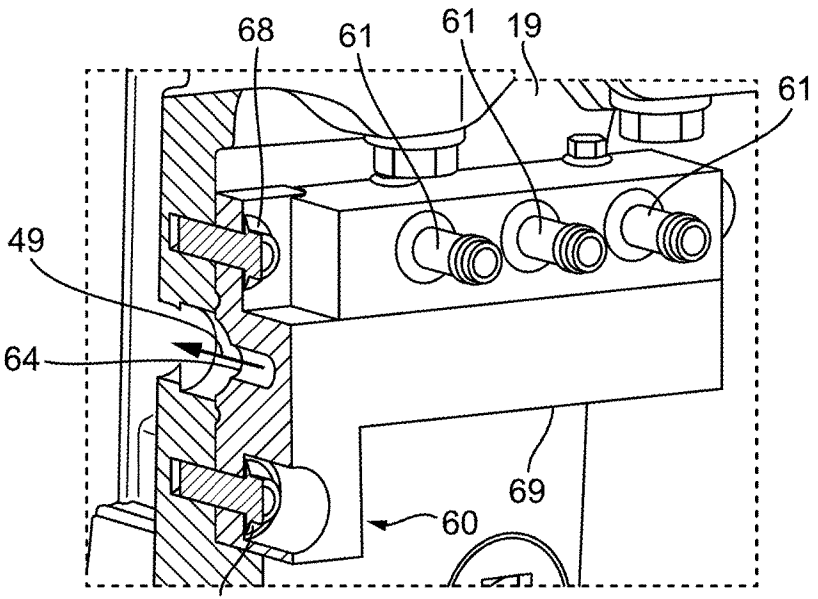
FIG. 3E is a cross-sectional view of a portion of the separation assembly of FIG. 1.

As shown in FIG. 3E, the jet pump housing 69 of the jet pump assembly 60 may be fastened or attached to the engine housing 19 through at least one fastener 68 (for example two fasteners, such as bolts) that extend into and through respective holes defined by the jet pump housing 69 and into respective holes defined by the engine housing 19.

As show in FIGS. 3A-3B, the jet pump assembly 60 comprises multiple (at least two) scavenge inlet ports, orifices, or drain inlets 61, each of which are oil drain ports and correspond to and are fluidly connected to the drain outlet 36 of one of the CV separators 30 through a respective drain line 40. The drain inlets 61 provide a fluid connection for the drain fluid 37 between respective one of the CV separators 30 and the jet pump assembly 60). As shown in FIGS. 4A-4C, the jet pump assembly 60 may comprise adapters or fittings 78, each of which are attached to one of the drain inlets 61 (through, for example, a threaded or welded attachment). Each of the fittings 78 may extend at least partially into the drain inlet 61 (or vice versa). Depending on whether the jet pump assembly 60 includes the fittings 78, either each of the drain inlets 61 or each of the fittings 78 attach to (e.g., extend over or into) the outlet of one of the drain lines 40, thereby fluidly attaching (and leading the drain fluid 37 from) the drain line 40 to the common plenum 72 via the drain inlet 61.

As shown in FIG. 3B, the jet pump assembly 60 comprises a common suction block, pressurized chamber, or plenum 72 that is a separate space that is configured to receive, fluidly combine, and contain the drain fluid 37 from each of the drain inlets 61 within the jet pump assembly 60 (optionally at an elevated pressure). The drain fluid 37 from each of the drain inlets 61 (and therefore from each of the drain lines 40 and each of the CV separators 30) joins and mixes together within the common plenum 72 prior to (e.g., upstream of) flowing through the check valve 71 and being mixed or integrated into the drive fluid 23. Accordingly, the common plenum 72 fluidly connects the drain fluid 37 from each of the drain inlets 61 prior to directing the drain fluid 37 toward the suction chamber 76 where the drain fluid 37 is mixed with the drive fluid 23. The common plenum 72 (and therefore each of the drain inlets 61 via the common plenum 72) is under suction pressure created by the drive fluid 23 flowing through the jet pump assembly 60.

As further shown in FIG. 3B, the jet pump assembly 60 comprises a single check valve 71 positioned between all of the drain inlets 61 and the motive inlet 62 (in particular between the common plenum 72 and the suction chamber 76) along the fluid flow direction. Accordingly, after the drain fluid 37 from each of the drain inlets 61 combines together within the common plenum 72 and flows through the common plenum 72, the common plenum 72 directs or feeds the drain fluid 37 through the check valve 71, with drain fluid 37 prevented from backflowing in adverse (e.g., cold) conditions. Subsequently, the check valve 71 directs the drain fluid 37 to flow from the common plenum 72 into the suction chamber 76, as described further herein. The check valve 71 is configured to prevent any fluid flow from flowing backwards (e.g., cold-condition backflow) from the suction chamber 76 to the common plenum 72. The check valve 71 comprises a valve chamber and a check ball positioned (and movable) within the valve chamber. The check valve 71 allows fluid to flow from the common plenum 72 to the suction chamber 76, but does not allow fluid to flow backward from the suction chamber 76 to the common plenum 72. According to one embodiment, the jet pump assembly 60 may include multiple check valves 71.

As further shown in FIG. 3B, the jet pump assembly 60 comprises a drive or motive port or inlet 62 (through which the drive fluid 23 enters into the jet pump assembly 60) and a motive or drive chamber 74. The drive chamber 74 is configured to receive the pressurized motive or drive fluid 23 from the drive line 25 (through the motive inlet 62) and direct the drive fluid 23 into the suction chamber 76, which draws fluid from the drain inlets 61 into the suction chamber 76 and through the jet pump assembly 60. According to one embodiment, the jet pump assembly 60 may comprise only one single motive inlet 62 with a corresponding drive chamber 74 (but still comprises multiple drain inlets 61), where the motive inlet 62 is a single inlet or entry point for the drive fluid 23. The drive fluid 23 is pressurized and pumped by the engine 22 (as shown in FIG. 1) toward the drive chamber 74. The drive fluid 23 flowing through the drive chamber 74 flows in parallel to and fluidly separate from the drain fluid 37 flowing through the common plenum 72 and the check valve 71. The drive chamber 74 includes an upstream inlet at the motive inlet 62 and a downstream outlet 73 (which may also be referred to as a motive jet outlet of the drive chamber 74 and as shown in FIG. 3B). The downstream outlet 73 is downstream from the motive inlet 62 and directly upstream from the fluid intersection between the drive chamber 74 and the check valve 71 (i.e., at the upstream inlet of the suction chamber 76). The downstream outlet 73 of the drive chamber 74 is relatively narrow compared to and smaller than the inlet (in particular the motive inlet 62 and the upstream inlet of the drive chamber 74) and thereby functions as a jet. In particular, the drive chamber 74 constricts the drive fluid 23 as the drive fluid 23 flows through the drive chamber 74 toward the suction chamber 76 to suck the drain fluid 37 into the suction chamber 76. The downstream outlet 73 is configured to provide suction to all of the drains (e.g., to each of the drain outlets 36 of each of the CV separators 30 and the corresponding drain lines 40), thereby drawing fluid downstream to and through the suction chamber 76.

Figure 4D:
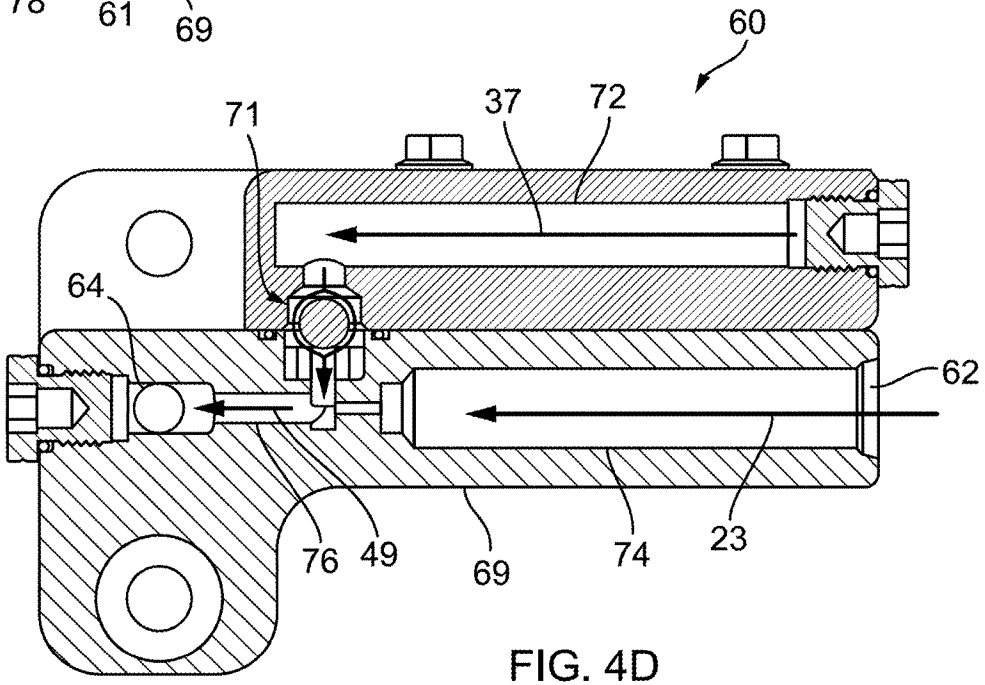
FIG. 4D is yet another cross-sectional view of the jet pump assembly of FIG. 4A.

The jet pump assembly 60 comprises a mixing and suction bore or chamber 76 that is positioned downstream from both the common plenum 72 (and the drain inlets 61 and the check valve 71) and the drive chamber 74 (and the motive inlet 62), as shown in FIG. 3B. The suction chamber 76 is configured to receive and fluidly combine the drive fluid 23 from the motive inlet 62 (and the drive chamber 74) and the drain fluid 37 from the drain inlets 61 (and the common plenum 72 and the check valve 71). In particular, the suction chamber 76 provides an area in which the drain fluid 37 from the common plenum 72 (and therefore from all of the CV separators 30) and the drive fluid 23 from the drive chamber 74 (and therefore from the engine 22) mix together. As the pressurized drive fluid 23 flows from the drive chamber 74 (through the constricted downstream outlet 73 of the drive chamber 74) and into the suction chamber 76, the drive fluid 23 creates a vacuum or driving force within the suction chamber 76 of the jet pump assembly 60, which imparts a suction force on the common plenum 72 and draws, pulls, or sucks the drain fluid 37 from the common plenum 72 (and therefore from the drain lines 40 and the CV separators 30) and further downstream into and through the jet pump assembly 60, toward the outlet 64 of the jet pump assembly 60 and the inlet 21 of the engine 22. FIGS. 4C-4D also show the path of fluid flow through the jet pump assembly 60.

The jet pump assembly 60 further comprises a discharge outlet 64 downstream from the suction chamber 76, as shown in FIG. 3B. The outlet 64 discharges the discharge fluid 49 (which is the drive fluid 23 and the drain fluid 37 combined together) into the discharge line 48 to flow into the inlet 21 of the engine 22 (and specifically into the sump 29) due to the adverse pressure gradient caused by the drive fluid 23. According to one embodiment, the jet pump assembly 60 may comprise only one single outlet 64 (but still comprises multiple drain inlets 61 and the motive inlet 62).

Orifice Assembly

As shown in FIG. 1, an orifice assembly 50 is positioned within each of the fluid flow paths of the separation assembly 20 between the drain outlet 36 of one of the CV separators 30 and one of the drain inlets 61 of the jet pump assembly 60, inclusively. For example, the orifice assembly 50 may be positioned at the drain outlet 36 or at the drain inlet 61 (or locations therebetween). By including the orifice assembly 50 within each of the fluid flow paths, the suction flow imparted by the single jet pump assembly 60 on each of the CV separators 30 and the corresponding drain lines 40 is reallocated and distributed more equally between and along each of the drain lines 40, thereby ensuring a desired minimal target suction pressure in each of the drain lines 40 and each of the CV separators 30 and preventing the drain lines 40 from hydrolocking.

The orifice assembly 50 is configured to restrict the fluid flow and create a small pressure drop along its respective fluid flow path between the drain outlet 36 of the CV separator 30 and its respective drain inlet 61 of the jet pump assembly 60. Due to the orifice assemblies 50, the desired pressure drop and level of suction along each of the fluid flow paths (across the orifice assembly 50) is maintained. Accordingly, even if all liquid within one of the drain lines 40 is completely evacuated of the drain line 40 (such that only air is flowing through the one drain line 40), the orifice assembly 50 will regulate or maintain the desired amount of suction pressure on the one emptied drain line 40 (through which only air is flowing), which allows a sufficient suction pressure to be maintained on the other non-emptied drain lines 40 and prevents these other non-emptied drain lines 40 from becoming hydrolocked with liquid.

Comparatively, without the orifice assembly 50, if all liquid within one of the drain lines 40 is completely evacuated of the drain line 40 (such that the drain line 40 is dry with no blockage and only air flows through the one drain line 40) or if one of the drain lines 40 is a "clean line" with air primarily flowing through, the other drain lines 40 would be negatively impacted. In particular, since all of the drain lines 40 have the same suction source within the jet pump assembly 60, most (or all) of the scavenge suction or suction pressure will be diverted to and cause air to flow through the empty drain line 40 without liquid (e.g., the clean drain line 40), which causes the level of suction pressure imparted on the other drain lines 40 (through which primarily liquid (such as storage oil) is flowing through) to decrease. Accordingly, only airflow is drawn through the one drain line 40, and the other drain lines 40 will not receive enough (or any) scavenge suction. This low suction pressure on the other drain lines 40 (with liquid) may not be sufficient to move the liquid through these other drain lines 40 and pulled into the sump 29, causing either the corresponding CV separators 30 to overfill or for these other drain lines 40 to become (and remain) hydrolocked. Being hydrolocked refers to when the drain line 40 is filled with drain fluid 37 (e.g., liquid) at its lowest point (i.e., along the bent portion 42) and filled with gas on either side of the column of liquid within the bent portion 42 and the suction pressure is insufficient to move the column of liquid and unblock the drain line 40. If the drain line 40 is hydrolocked, the liquid within drain line 40 may potentially freeze within the drain line 40, thereby potentially damaging the separation assembly 20. Conversely, by including the orifice assembly 50 within the separation assembly 20 (and thereby limiting the suction through the reduced area of the orifice 54), this type of jet pump failure is avoided since the amount of suction pressure exerted on the unblocked drain line 40 is restricted, causing the rest of the suction pressure to be distributed or diverted to the other drain lines 40, which prevents the other drain lines 40 from becoming blocked or hydrolocked.

Figure 3C:
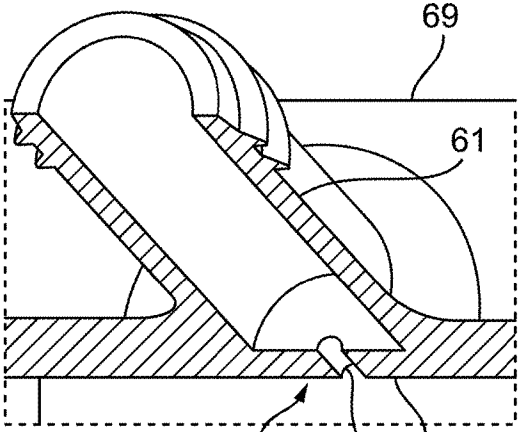
FIG. 3C is a cross-sectional view of a portion of the jet pump assembly of FIG. 3A.

As shown in FIGS. 3C-3D, the orifice assembly 50 (which may be a throttle) comprises a plate 52 that defines at least one throttling aperture or capillary or orifice 54 that extends completely through the plate 52 and provides a fluid path through the plate 52. The orifice 54 works as a throttle to distribute the suction pressure (from the common plenum 72) more uniformly across each of the drain lines 40, which prevents hydrolocking. Aside from the orifice 54, the orifice assembly 50 (in particular the plate 52) extends along the entire cross-sectional area of the flow path between a CV separator 30 and the common plenum 72 such that the orifice assembly 50 (in particular the plate 52) completely blocks the flow of fluid along the fluid flow path except along the orifice 54. Accordingly, fluid must flow through the orifice 54 in order to flow past the orifice assembly 50. According to one embodiment, the plate 52 comprises only one orifice 54. However, according to various other embodiments, the plate 52 may include any number of orifices 54 (e.g., capillaries). The diameter of the orifice 54 (which is the inner diameter of the plate 52) may be significantly smaller than the outer diameter of the plate 52 and the inner diameter of the corresponding drain line 40. The diameter of the orifice 54 is significantly smaller than the inner diameter of the various components defining the fluid flow path upstream from the orifice 54 (and optionally also the inner diameter of the various components downstream from the orifice 54, such as the inner diameters of the drain inlet 61 and/or the common plenum 72).

Each of the orifice assemblies 50 are in series with the fluid flow through its respective drain line 40, such that all fluid flowing through the drain lines 40 also flows through its respective orifice assembly 50 (prior to flowing into the common plenum 72). Each of the orifice assemblies 50 may be positioned along a variety of different areas along the fluid flow path between each of the CV separators 30 and the common plenum 72 of the jet pump assembly 60. Each of the orifice assemblies 50 is positioned downstream from a main separation area of one of the CV separator 30 and upstream from the common plenum 72 of the jet pump assembly 60.

According to one embodiment as shown in FIG. 3B, each of the orifice assemblies 50 may be integrated with and positioned within the drain inlets 61 of the jet pump housing 69. Accordingly, the orifice assembly 50 may be constructed as a single-piece with at least a portion of the jet pump housing 69 of the jet pump assembly 60 (in particular the portion of the jet pump housing 69 that defines the drain inlets 61 and the common plenum 72) as a single unitary component that cannot be separated without destruction.

According to another embodiment as shown in FIGS. 4A-4C, each of the orifice assemblies 50 may be integrated with and positioned within one of the fittings 78 of the jet pump assembly 60. Accordingly, the orifice assembly 50 may be constructed as a single-piece with one of the fittings 78 of the jet pump assembly 60 as a single unitary component that cannot be separated without destruction. In this embodiment, the orifice assemblies 50 may be separate components from the jet pump housing 69. In each of the embodiments shown in FIGS. 3B and FIGS. 4A-4C, each of the orifice assemblies 50 is positioned along and restricts fluid flow along a respective flow path between a respective one of the drain inlets 61 and the check valve 71.

Referring to the embodiment shown in FIG. 5, each of the orifice assemblies 50 may be integrated with and positioned within the drain outlets 36 of one of the CV separators 30 at or around location 101. Alternatively, each of the orifice assemblies 50 may be positioned near or in one of the drain lines 40 along the fluid flow path. For example, the orifice assembly 50 may be integrated with and positioned within the drain line 40 at or around alternate location 102 (which may be a portion of the drain line 40 that is downstream from the bent portion 42). Although the embodiments of FIG. 5 may include any of the features disclosed herein, certain features (such as the other CV separators 30) are not drawn in FIG. 5 for simplicity. Accordingly, the orifice assembly 50 may be constructed as a single-piece with a drain outlet 36 of one of the CV separators 30 or one of the drain lines 40 as a single unitary component that cannot be separated without destruction.

Each of the various embodiments disclosed herein may have any of the features, components, and configurations of the other embodiments, except where noted otherwise.

The size (i.e., the diameter) of the orifice 54 may vary depending on the configuration and size of the rest of the separation assembly 20 and the desired suction pressure drop along the corresponding fluid flow path (which may depend on the height H of the bent portion 42 of the drain line 40, as shown in FIG. 2B). As shown in FIG. 2B, the height H is the distance (e.g., vertical distance) between the drain inlet 61 and the lowest portion of the corresponding drain line 40 (in a direction away from the corresponding CV separator 30), which is along the bent portion 42. Since the height H of the drain line 40 changes how much pressure is needed to prevent the drain line 40 from hydrolocking (and the size (i.e., the diameter) of the orifice 54 changes the amount of suction pressure exerted on the drain line 40), the size of the orifice 54 depends on the height H of the drain line 40. The size of the orifice 54 is such that the orifice assembly 50 creates a change in pressure that is greater than the amount of pressure needed to pull liquid along the height H of the drain line 40, even if one of the drain lines 40 is open with air flowing through and another one of the drain lines 40 is hydrolocked. The distance D is the distance (e.g., vertical distance) between the bottom of the CV separator 30 at the drain outlet 36 and the drain inlet 61.

As one example, if the height H of a drain line 40 is approximately 80 millimeters (mm), this drain line 40 would need a suction pressure greater than approximately 0.7 kilopascals (kPa) to move the hydrolocked drain fluid 37 within the bent portion 42 (thereby preventing the drain line 40 from becoming or remaining hydrolocked). Therefore, the diameter of the orifice 54 would need to be approximately 0.8 mm to create a sufficient suction force or backpressure (of approximately 1 kPa) to equalize the suction among each of the fluid flow paths through each of the drain lines 40 and enable the hydrolocked drain line 40 to be cleared. This example assumes that the diameter of the motive jet outlet 73 of the drive chamber 74 is approximately 2 mm, the diameter of the mixing and suction chamber 76 is approximately 4.5 mm, the motive pressure is approximately 50 pounds per square inch (PSID), and the drive fluid 23 is SAE15W40 oil at 80° C. For reference, the distance D may be approximately 44 mm in this example.

Figure 6A:
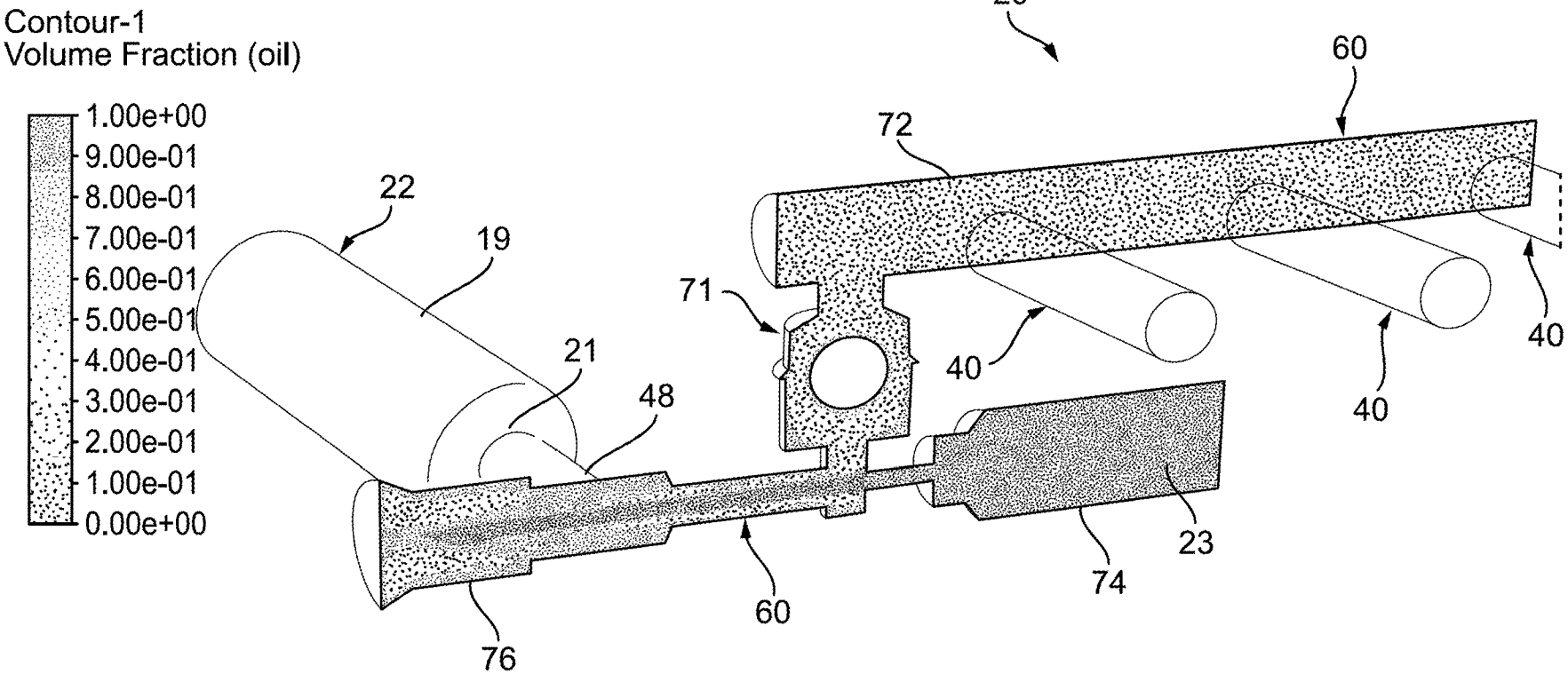
FIG. 6A is an empirical representation showing volume fraction of oil within a portion of a separation assembly during operation.
Figure 6B:
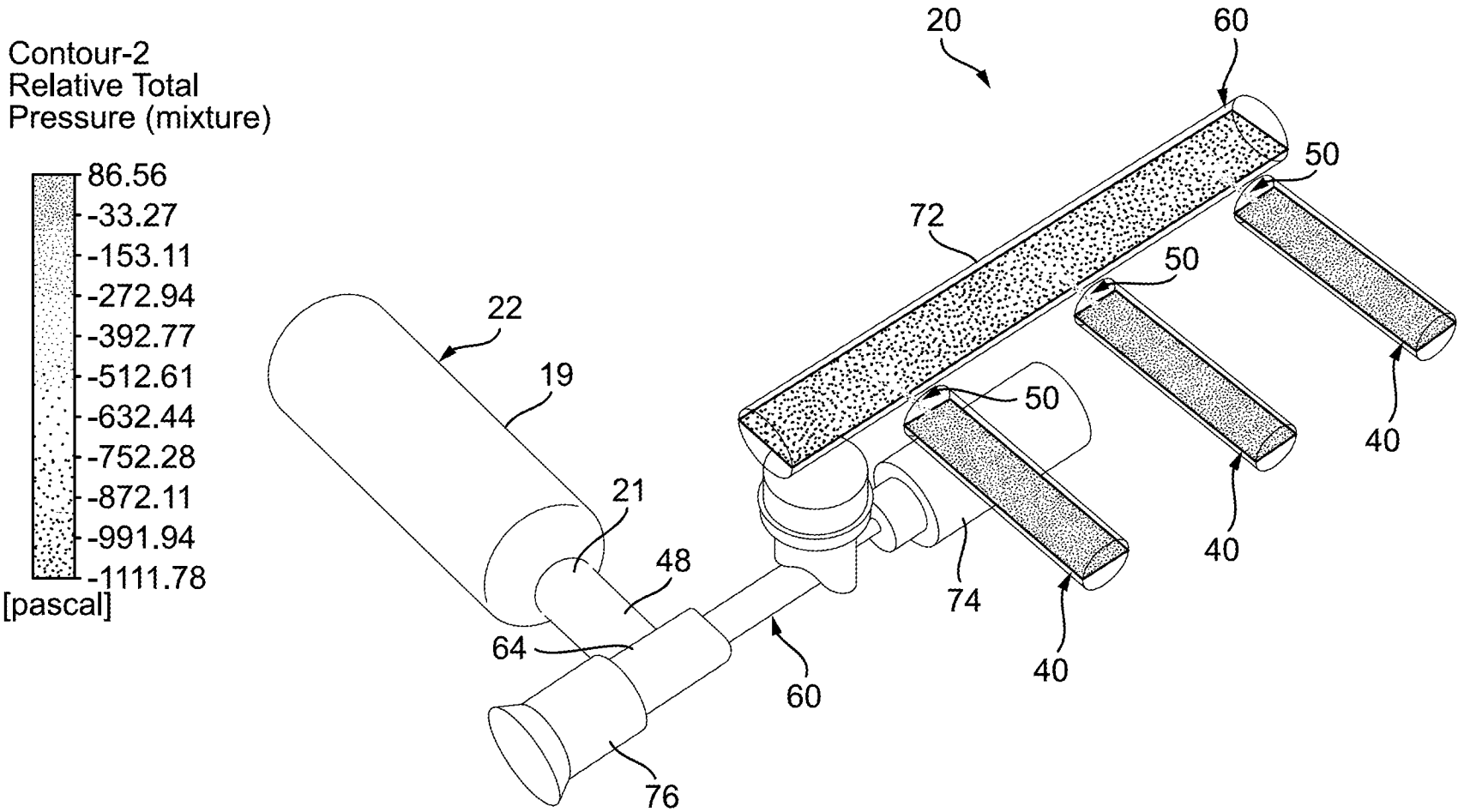
FIG. 6B is an empirical representation showing pressure within a portion of a separation assembly during operation.

FIGS. 6A-6B show empirical representations of fluid flow through the separation assembly 20. In particular, FIG. 6A shows contours of the volume fraction of oil with a two-phase flow in the jet pump assembly 60. FIG. 6B shows contours of the total pressure. As shown, the orifice assemblies 50 create a backpressure of approximately 1 kPa, which would be sufficient to overcome a hydrolocked drain line 40 of up to 100 mm in height H.

The fluid flow area through each of the orifice assemblies 50 may be different from each other to provide different flow rates and to balance the fluid flow across the CV separators 30. For example, the orifices 54 of the various orifice assemblies 50 within the CV separator 30 may be different sizes from each other (or each of the orifice assemblies 50 may have a different number of orifices 54 from each other) to provide different total flow areas and flow rates within each of the fluid flow paths between each of the CV separators 30 and the common plenum 72. This configuration may be particularly useful if different drain rates are required for each of the CV separators 30. Accordingly, the jet pump assembly 60 may draw drain fluid 37 out from each of the drain lines 40 that correspond to two different types of CV separators 30. For example, the jet pump assembly 60 may drain from or draw drain fluid 37 out from both a CV separator 30 that is a pre-separator and a CV separator 30 that is an aerosol separator, which have vastly different required drain rates from each other. Therefore, the flow area through each of the orifices assemblies 50 may be different from each other to provide the respective required drain rate. Alternatively, the orifices 54 of the various orifice assemblies 50 may be the same size as each other (or have the same number of orifices 54) to provide the same total flow area and flow rates within each of the fluid flow paths.

Drain Line Connections

Figure 7A:
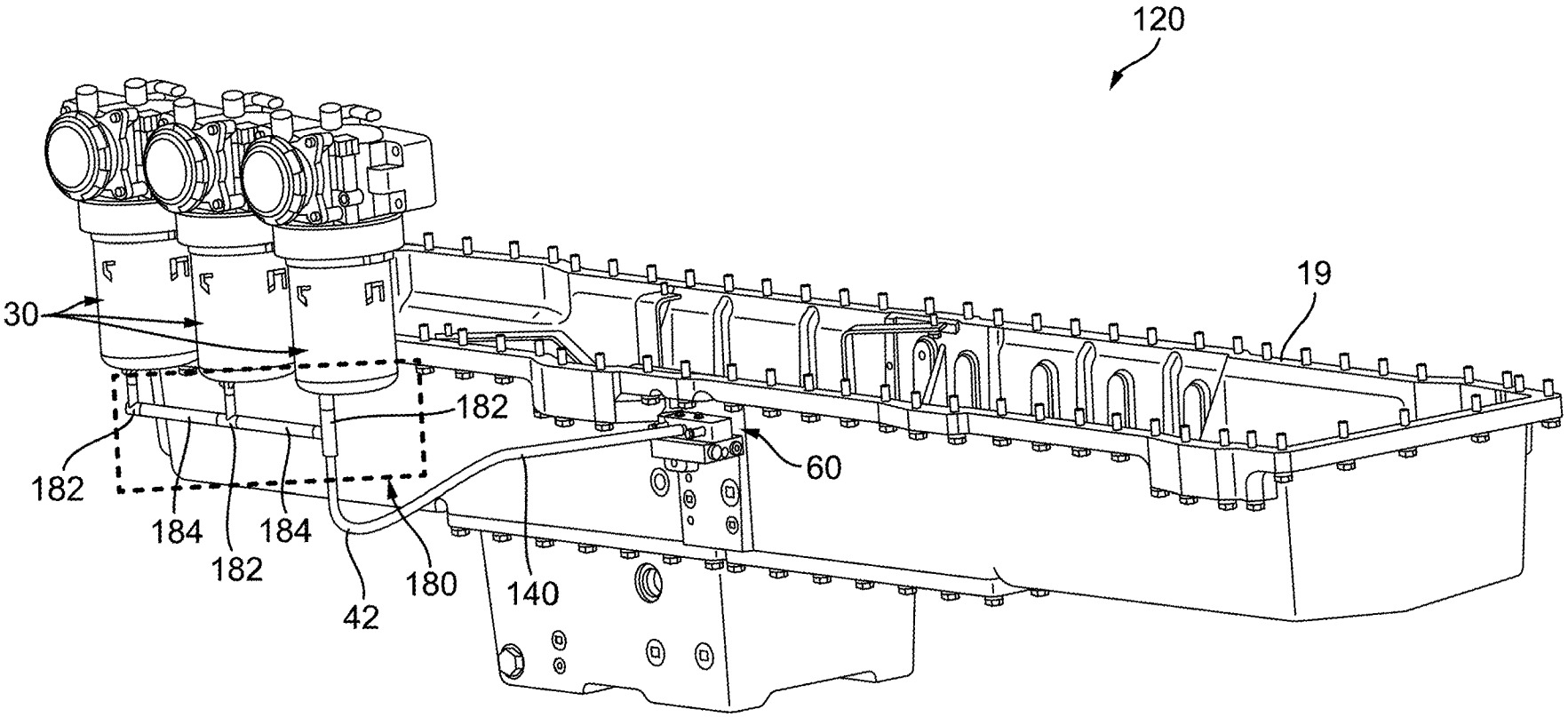
FIG. 7A is a perspective view of a separation assembly according to another embodiment.
Figure 7B:
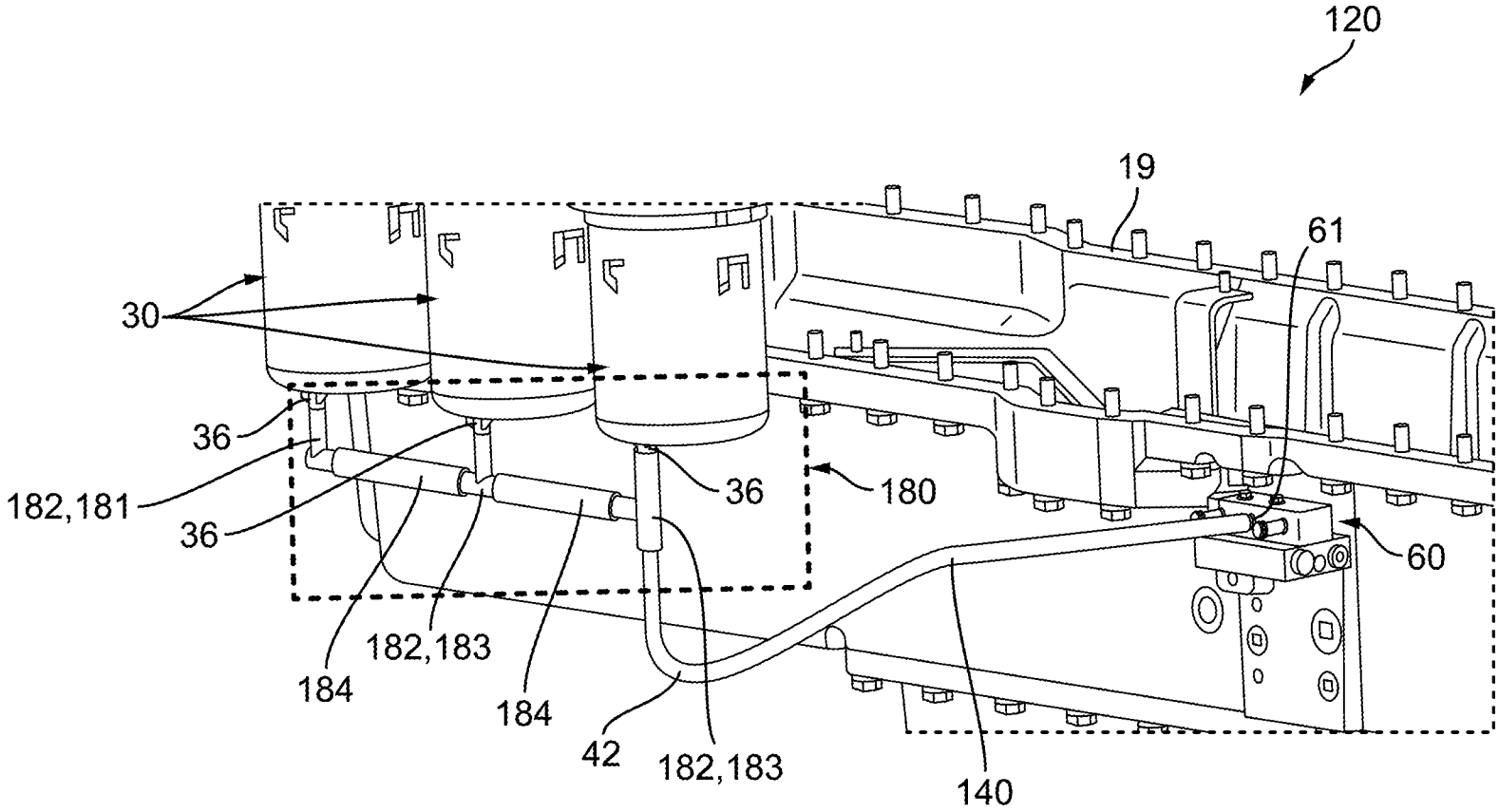
FIG. 7B is an enlarged portion of the separation assembly of FIG. 7A.
Figure 8:
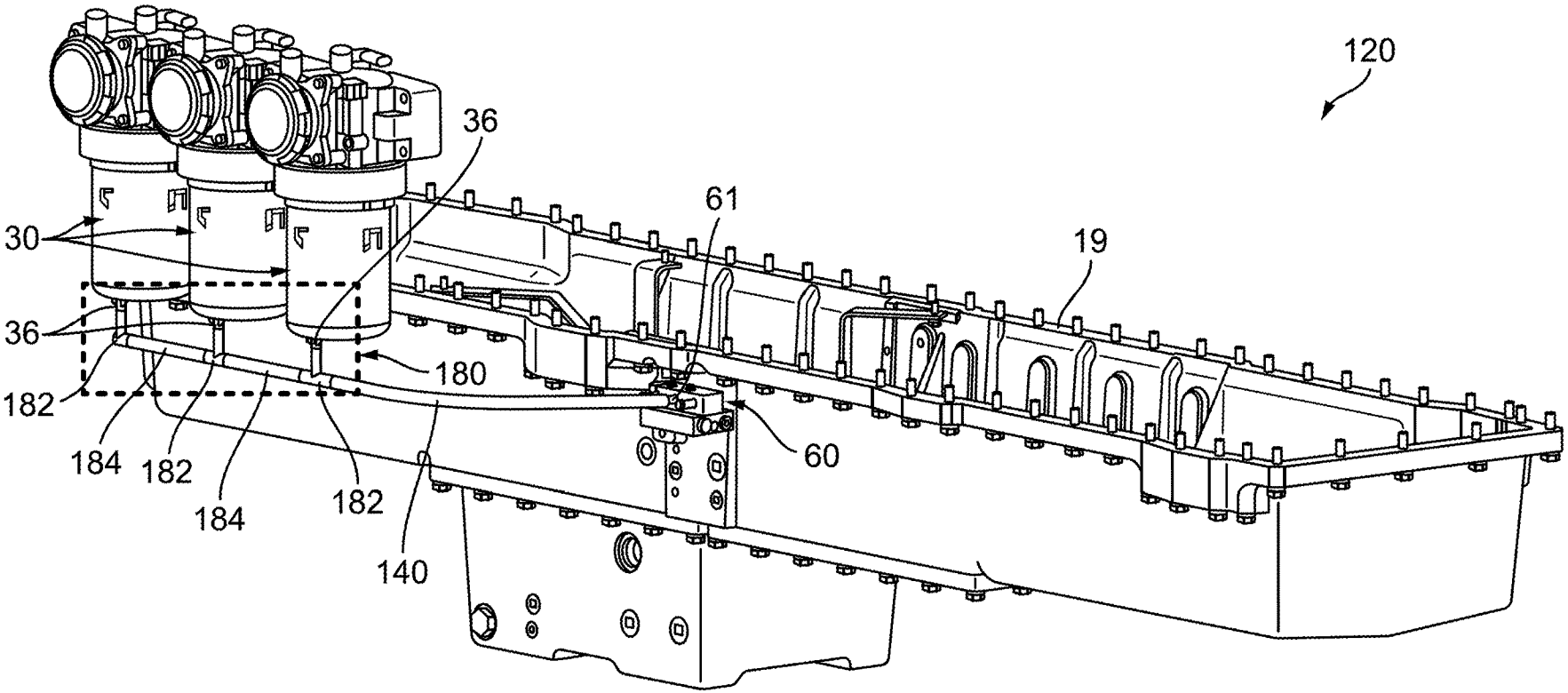
FIG. 8 is a perspective view of a separation assembly according to yet another embodiment.

FIGS. 7A-8 show various embodiments of a separation assembly 120, which provide alternate ways of fluidly attaching the jet pump assembly 60 to each of the CV separators 30. The separation assembly 120 comprises a header 180 and a combined connecting hose or drain line 140 (instead of the multiple separate drain lines 40).

The header 180 comprises a plurality of (i.e., at least two) upstream inlets that are fluidly attached or connected to the drain outlets 36 of each of the CV separators 30 and a downstream outlet (in particular an outlet of a T-shaped connector joint 183) that is fluidly attached or connected to the upstream inlet of the combined drain line 140. The downstream outlet of the combined drain line 140 is fluidly attached to one of the drain inlets 61 of the jet pump assembly 60. Accordingly, the header 180 is positioned between and fluidly connects each of the CV separators 30 and the combined drain line 140 along the fluid flow path, and the combined drain line 140 is positioned between and fluidly connects the header 180 and the jet pump assembly 60 along the fluid flow path.

The header 180 is upstream of the combined drain line 140 and fluidly combines the drain fluid 37 from all of the CV separators 30 in an area near the drain outlets 36 of the CV separators 30 (rather than within the jet pump assembly 60), prior to flowing through the combined drain line 140 and prior to flowing into the jet pump assembly 60. All of the combined drain fluid 37 (i.e., the drain fluid 37 from all of the CV separators 30) from the header 180 subsequently flows through the single combined drain line 140 to one drain inlet 61 of the jet pump assembly 60 (rather than to multiple drain inlets 61). The combined drain line 140 transfers the combined drain fluid 37 from the header 180 to the jet pump assembly 60.

The header 180 comprises at least two connector joints 182 (which each define an inlet of the header 180, each of which are attached to the drain outlet 36 of one of the CV separators 30) and at least one connector hose 184. A connector joint 182 is included for and corresponds to each CV separator 30. Each of the connector joints 182 are attached to at least one other connector joint 182 through a connector hose 184 (which fluidly connects two connector joints 182).

The connector joints 182 may be an L-shaped connector joint 181 with only one first upstream inlet (fluidly attached to the drain outlet 36 of a CV separator 30) and one downstream outlet (fluidly attached to the upstream end of the connector hose 184) or may be a T-shaped connector joint 183 with the first upstream inlet (fluidly attached to the drain outlet 36 of a CV separator 30), a second upstream inlet (fluidly attached to the downstream end of the connector hose 184), and one downstream outlet (fluidly attached to the upstream end of the connector hose 184 or the upstream end of the combined drain line 140). An L-shaped connector joint 181 is attached to the first, most upstream CV separator 30. The T-shaped connector joints 183 are attached to all subsequent CV separators 30 and a connector hose 184 and output combined drain fluid 37 to either another connector hose 184 or the combined drain line 140, thereby fluidly combining the drain fluid 37 from each of the CV separators 30. The T-shaped connector joint 183 is fluidly attached to the last, most downstream CV separator 30, and the outlet of this T-shaped connector joint 183 is attached to the inlet of the combined drain line 140.

The first inlets of the connector joints 182 (both the L-shaped connector joint 181 and the T-shaped connector joint 183) are fluidly attached to (and receive drain fluid 37 from) the drain outlet 36 of one of the CV separators 30. The outlet of the L-shaped connector joint 181 is attached to and outputs drain fluid 37 into an upstream inlet of a connector hose 184. The second inlet of the T-shaped connector joint 183 is fluidly attached to (and receives drain fluid 37 from) a downstream outlet of a connector hose 184 (which may be the same connector hose 184 that is attached to the outlet of the L-shaped connector joint 181, depending on the number of CV separators 30 and the position of the T-shaped connector joint 183 along the fluid flow path). The drain fluids 37 entering into the first inlet and the second inlet of the T-shaped connector joint 183 are from different CV separators 30. The T-shaped connector joint 183 fluidly combines these drain fluids 37. The outlet of the T-shaped connector joint 183 is fluidly attached to (and outputs combined drain fluid 37 into) either the upstream inlet of either another connector hose 184 or the combined drain line 140 (depending on the number of CV separators 30 and the position of the T-shaped connector joint 183 along the fluid flow path).

It is noted that the configurations shown in FIGS. 7A-8 are exemplary and other arrangements may be used. For example, the connector hoses 184 may optionally use snaps to attach to the connector joints 182. Furthermore, the combined drain line 140 can connect to a variety of different portions of the header 180, such as locations farthest away from or closest to the jet pump assembly 60.

The combined drain line 140 may include any of the features or configurations of the drain line 40, except where noted otherwise. For example, as shown in FIGS. 7A-7B, the combined drain line 140 includes a bent portion 42 (as described further herein) along which the combined drain line 140 curves along its length between the CV separator 30 (and the header 180) and the jet pump assembly 60. However, as shown in FIG. 8, the combined drain line 140 may extend in a relatively straight line (e.g., without extending vertically below the jet pump assembly 60) between the header 180 and the jet pump assembly 60, without any bent portion 42.

The separation assembly 120 may include any of the aspects, features, components, or configurations of the separation assembly 20, except where noted otherwise. As one example, the separation assembly 120 may optionally include the orifice assembly 50, but is functional without the orifice assembly 50 since the header 180 only allows a marginal variation in the drain rate from each of the CV separators 30.

As utilized herein, the term "approximately" and similar terms are intended to have a broad meaning in harmony with the common and accepted usage by those of ordinary skill in the art to which the subject matter of this disclosure pertains. The term "approximately" as used herein refers to ±5% of the referenced measurement, position, or dimension. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," "attached," and the like as used herein mean the joining of two members directly to one another. Such joining may be stationary (e.g., permanent) or moveable (e.g., removable or releasable).

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

Aspects of the disclosure may be implemented in one or more embodiments below.

1) A separation assembly comprising:
   - a first crankcase ventilation separator comprising a first drain outlet;
   - a second crankcase ventilation separator comprising a second drain outlet; and
   - a jet pump assembly comprising a first drain inlet fluidly connected to the first drain outlet of the first crankcase ventilation separator and a second drain inlet fluidly connected to the second drain outlet of the second crankcase ventilation separator, the jet pump assembly providing suction pressure to both the first drain outlet of the first crankcase ventilation separator and the second drain outlet of the second crankcase ventilation separator.
2) The separation assembly of 1), further comprising: a first orifice assembly positioned along a first flow path between the first drain outlet of the first crankcase ventilation separator and the first drain inlet of the jet pump assembly, or positioned at the first drain outlet or the first drain inlet, and defining a first orifice that restricts fluid flow along the first flow path; and a second orifice assembly positioned along a second flow path between the second drain outlet of the second crankcase ventilation separator and the second drain inlet of the jet pump assembly, or positioned at the second drain outlet or the second drain inlet, and defining a second orifice that restricts fluid flow along the second flow path.
3) The separation assembly of 2), wherein the first orifice assembly is positioned within the first drain inlet, and the second orifice assembly is positioned within the second drain inlet.
4) The separation assembly of 2), wherein the first orifice assembly is positioned within the first drain outlet of the first crankcase ventilation separator, and the second orifice assembly is positioned within the second drain outlet of the second crankcase ventilation separator.
5) The separation assembly of 2), wherein the jet pump assembly comprises a first fitting attached to the first drain inlet and a second fitting attached to the second drain inlet, and wherein the first orifice assembly is positioned within the first fitting and the second orifice assembly is positioned within the second fitting.

6) The separation assembly of 2), further comprising: a first drain line fluidly connecting the first drain outlet of the first crankcase ventilation separator to the first drain inlet of the jet pump assembly and defining a portion of the first flow path; and a second drain line fluidly connecting the second drain outlet of the second crankcase ventilation separator to the second drain inlet of the jet pump assembly and defining a portion of the second flow path.

7) The separation assembly of 6), wherein the first orifice assembly is positioned in the first drain line, and the second orifice assembly is positioned in the second drain line.

8) The separation assembly of 6), wherein the first drain line and the second drain line have the same suction source within the jet pump assembly.

9) The separation assembly of 1), wherein the jet pump assembly comprises a common plenum that is configured to receive and fluidly combine drain fluid from both the first drain inlet and the second drain inlet.

10) The separation assembly of 9), wherein the jet pump assembly comprises a check valve downstream from the common plenum and a suction chamber positioned downstream from the check valve, the check valve directing the drain fluid to flow from the common plenum into the suction chamber and preventing the drain fluid from flowing backward from the suction chamber to the common plenum.

11) The separation assembly of 1), wherein the jet pump assembly comprises: a motive inlet configured to receive drive fluid to draw scavenge fluid from the first drain inlet and the second drain inlet into and through the jet pump assembly; and a suction chamber positioned downstream from the first drain inlet and the second drain inlet and the motive inlet, wherein the suction chamber is configured to receive and fluidly combine the drive fluid from the motive inlet and drain fluid from the first drain inlet and the second drain inlet.

12) The separation assembly of 11), wherein the jet pump assembly comprises a single motive inlet.

13) A separation assembly comprising:

a first crankcase ventilation separator comprising a first drain outlet;

a second crankcase ventilation separator comprising a second drain outlet; and a jet pump assembly fluidly connected to the first drain outlet of the first crankcase ventilation separator and the second drain outlet of the second crankcase ventilation separator, the jet pump assembly providing suction pressure to both the first drain outlet of the first crankcase ventilation separator and the second drain outlet of the second crankcase ventilation separator.

14) The separation assembly of 13), further comprising: a first orifice assembly positioned along a first flow path between the first drain outlet of the first crankcase ventilation separator and the jet pump assembly, or positioned at the first drain outlet or the jet pump assembly, and defining a first orifice that restricts fluid flow along the first flow path; and a second orifice assembly positioned along a second flow path between the second drain outlet of the second crankcase ventilation separator and the jet pump assembly, or positioned at the second drain outlet or the jet pump assembly, and defining a second orifice that restricts fluid flow along the second flow path.

15) The separation assembly of 14), further comprising: a first drain line fluidly connecting the first drain outlet of the first crankcase ventilation separator to a first drain inlet of the jet pump assembly and defining a portion of the first flow path; and a second drain line fluidly connecting the second drain outlet of the second crankcase ventilation separator to a second drain inlet of the jet pump assembly and defining a portion of the second flow path.

16) The separation assembly of 13), further comprising: a header combining drain fluid from the first crankcase ventilation separator and drain fluid from the second crankcase ventilation separator; and a combined drain line fluidly connecting the header to the jet pump assembly.

17) The separation assembly of 16), wherein the header comprises a first drain inlet fluidly connected to the first drain outlet of the first crankcase ventilation separator and a second drain inlet fluidly connected to the second drain outlet of the second crankcase ventilation separator.

18) The separation assembly of 16), wherein the header fluidly combines the drain fluid from the first crankcase ventilation separator and the drain fluid from the second crankcase ventilation separator prior to flowing into the jet pump assembly.

19) A jet pump assembly comprising:

a first drain inlet fluidly connected to a first drain outlet of a first crankcase ventilation separator;

a second drain inlet fluidly connected to a second drain outlet of a second crankcase ventilation separator; and a motive inlet through which drive fluid enters the jet pump assembly to draw fluid from the first drain inlet and the second drain inlet through the jet pump assembly, wherein the jet pump assembly provides suction pressure to both the first drain outlet of the first crankcase ventilation separator and the second drain outlet of the second crankcase ventilation separator.

20) The jet pump assembly of 19), further comprising a check valve positioned between the first and second drain inlets and the motive inlet.

21) The jet pump assembly of 20), further comprising at least one orifice assembly positioned along and restricting fluid flow along a flow path between one of the first drain inlet and the second drain inlet and the check valve.

22) The jet pump assembly of 19), further comprising a motive jet outlet downstream of the motive inlet, the motive jet outlet providing suction to the first drain outlet of the first crankcase ventilation separator and the second drain outlet of the second crankcase ventilation separator.

What is claimed is:

1. A separation assembly comprising:

a first crankcase ventilation separator comprising a first drain outlet;

a second crankcase ventilation separator comprising a second drain outlet; and a jet pump assembly comprising:

a first drain inlet fluidly connected to the first drain outlet of the first crankcase ventilation separator and a second drain inlet fluidly connected to the second drain outlet of the second crankcase ventilation separator, the jet pump assembly providing suction pressure to both the first drain outlet of the first crankcase ventilation separator and the second drain outlet of the second crankcase ventilation separator; and a motive inlet through which drive fluid enters the jet pump assembly to draw fluid from the first drain inlet and the second drain inlet through the jet pump assembly.

2. The separation assembly of claim 1, further comprising:

a first orifice assembly positioned along a first flow path between the first drain outlet of the first crankcase ventilation separator and the first drain inlet of the jet pump assembly, positioned at the first drain outlet, or positioned at the first drain inlet, and defining a first orifice that restricts fluid flow along the first flow path; and a second orifice assembly positioned along a second flow path between the second drain outlet of the second crankcase ventilation separator and the second drain inlet of the jet pump assembly, positioned at the second drain outlet, or positioned at the second drain inlet, and defining a second orifice that restricts fluid flow along the second flow path.

3. The separation assembly of claim 2, wherein the first orifice assembly is positioned within the first drain inlet, and the second orifice assembly is positioned within the second drain inlet.

4. The separation assembly of claim 2, wherein the first orifice assembly is positioned within the first drain outlet of the first crankcase ventilation separator, and the second orifice assembly is positioned within the second drain outlet of the second crankcase ventilation separator.

5. The separation assembly of claim 2, wherein the jet pump assembly comprises a first fitting attached to the first drain inlet and a second fitting attached to the second drain inlet, and wherein the first orifice assembly is positioned within the first fitting and the second orifice assembly is positioned within the second fitting.

6. The separation assembly of claim 2, further comprising:

a first drain line fluidly connecting the first drain outlet of the first crankcase ventilation separator to the first drain inlet of the jet pump assembly and defining a portion of the first flow path; and a second drain line fluidly connecting the second drain outlet of the second crankcase ventilation separator to the second drain inlet of the jet pump assembly and defining a portion of the second flow path.

7. The separation assembly of claim 6, wherein the first orifice assembly is positioned in the first drain line, and the second orifice assembly is positioned in the second drain line.

8. The separation assembly of claim 6, wherein the first drain line and the second drain line have the same suction source within the jet pump assembly.

9. The separation assembly of claim 1, wherein the jet pump assembly comprises a common plenum that is configured to receive and fluidly combine drain fluid from both the first drain inlet and the second drain inlet.

10. The separation assembly of claim 1, wherein the jet pump assembly comprises:

a suction chamber positioned downstream from the first drain inlet and the second drain inlet and the motive inlet, wherein the suction chamber is configured to receive and fluidly combine the drive fluid from the motive inlet and drain fluid from the first drain inlet and the second drain inlet.

11. The separation assembly of claim 10, wherein the jet pump assembly comprises a single motive inlet.

12. A separation assembly comprising:

a first crankcase ventilation separator comprising a first drain outlet a second crankcase ventilation separator comprising a second drain outlet and a jet pump assembly comprising:

a first drain inlet fluidly connected to the first drain outlet of the first crankcase ventilation separator and a second drain inlet fluidly connected to the second drain outlet of the second crankcase ventilation separator, the jet pump assembly providing suction pressure to both the first drain outlet of the first crankcase ventilation separator and the second drain outlet of the second crankcase ventilation separator; and a motive inlet through which drive fluid enters the jet pump assembly to draw fluid from the first drain inlet and the second drain inlet through the jet pump assembly, wherein the jet pump assembly comprises a common plenum that is configured to receive and fluidly combine drain fluid from both the first drain inlet and the second drain inlet, and wherein the jet pump assembly comprises a check valve downstream from the common plenum and a suction chamber positioned downstream from the check valve, the check valve directing the drain fluid to flow from the common plenum into the suction chamber and preventing the drain fluid from flowing backward from the suction chamber to the common plenum.

13. A separation assembly comprising:

a first crankcase ventilation separator comprising a first drain outlet;

a second crankcase ventilation separator comprising a second drain outlet;

a jet pump assembly fluidly connected to the first drain outlet of the first crankcase ventilation separator and the second drain outlet of the second crankcase ventilation separator, the jet pump assembly providing suction pressure to both the first drain outlet of the first crankcase ventilation separator and the second drain outlet of the second crankcase ventilation separator; and a motive jet outlet, the motive jet outlet providing suction to the first drain outlet of the first crankcase ventilation separator and the second drain outlet of the second crankcase ventilation separator.

14. The separation assembly of claim 13, further comprising:

a first orifice assembly positioned along a first flow path between the first drain outlet of the first crankcase ventilation separator and the jet pump assembly, positioned at the first drain outlet, or positioned at the jet pump assembly, and defining a first orifice that restricts fluid flow along the first flow path; and a second orifice assembly positioned along a second flow path between the second drain outlet of the second crankcase ventilation separator and the jet pump assembly, positioned at the second drain outlet, or positioned at the jet pump assembly, and defining a second orifice that restricts fluid flow along the second flow path.

15. The separation assembly of claim 14, further comprising:

a first drain line fluidly connecting the first drain outlet of the first crankcase ventilation separator to a first drain inlet of the jet pump assembly and defining a portion of the first flow path; and a second drain line fluidly connecting the second drain outlet of the second crankcase ventilation separator to a second drain inlet of the jet pump assembly and defining a portion of the second flow path.

16. The separation assembly of claim 13, further comprising:

a header combining drain fluid from the first crankcase ventilation separator and drain fluid from the second crankcase ventilation separator; and a combined drain line fluidly connecting the header to the jet pump assembly.

17. The separation assembly of claim 16, wherein the header comprises a first drain inlet fluidly connected to the first drain outlet of the first crankcase ventilation separator and a second drain inlet fluidly connected to the second drain outlet of the second crankcase ventilation separator.

18. The separation assembly of claim 16, wherein the header fluidly combines the drain fluid from the first crankcase ventilation separator and the drain fluid from the second crankcase ventilation separator prior to flowing into the jet pump assembly.

19. A jet pump assembly comprising:

a first drain inlet fluidly connected to a first drain outlet of a first crankcase ventilation separator;

a second drain inlet fluidly connected to a second drain outlet of a second crankcase ventilation separator; and a motive inlet through which drive fluid enters the jet pump assembly to draw fluid from the first drain inlet and the second drain inlet through the jet pump assembly, wherein the jet pump assembly provides suction pressure to both the first drain outlet of the first crankcase ventilation separator and the second drain outlet of the second crankcase ventilation separator.

20. The jet pump assembly of claim 19, further comprising a check valve positioned between the first and second drain inlets and the motive inlet.

21. The jet pump assembly of claim 20, further comprising at least one orifice assembly positioned along and restricting fluid flow along a flow path between one of the first drain inlet and the second drain inlet and the check valve.

22. The jet pump assembly of claim 19, further comprising a motive jet outlet downstream of the motive inlet, the motive jet outlet providing suction to the first drain outlet of the first crankcase ventilation separator and the second drain outlet of the second crankcase ventilation separator.

* * * * *